US011175611B2

(12) United States Patent
Mimura et al.

(10) Patent No.: US 11,175,611 B2
(45) Date of Patent: Nov. 16, 2021

(54) OPTICAL SCANNING DEVICE HAVING CLEANING UNIT AND IMAGE FORMING APPARATUS HAVING THE SAME

(71) Applicant: KYOCERA Document Solutions Inc., Osaka (JP)

(72) Inventors: Daisuke Mimura, Osaka (JP); Hidenori Takenaka, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/064,756

(22) Filed: Oct. 7, 2020

(65) Prior Publication Data

US 2021/0124289 A1 Apr. 29, 2021

(30) Foreign Application Priority Data

Oct. 29, 2019 (JP) ..... JP2019-196607

(51) Int. Cl.
*G03G 15/16* (2006.01)
*G03G 21/16* (2006.01)

(52) U.S. Cl.
CPC ..... *G03G 15/166* (2013.01); *G03G 21/169* (2013.01); *G03G 2215/2064* (2013.01); *G03G 2221/0005* (2013.01)

(58) Field of Classification Search
CPC ..... G03G 15/166; G03G 21/169; G03G 2215/2064; G03G 2221/0005
See application file for complete search history.

(56) References Cited

U.S. PATENT DOCUMENTS 9,915,911 B2 * 3/2018 Mimura ..... G03G 15/04

FOREIGN PATENT DOCUMENTS

JP 2017-177396 10/2017
WO WO-2017203843 A1 * 11/2017 ..... H04N 1/113

* cited by examiner

*Primary Examiner* — Joseph S Wong
(74) *Attorney, Agent, or Firm* — Lex IP Meister, PLLC

(57) ABSTRACT

An optical scanning device includes a light transmitting member, a guide rail, a holding member, and a cleaning member. The light transmitting member extends in a main scanning direction and transmits a light beam. The guide rail extends in the main scanning direction and is arranged parallel to the light transmitting member. The holding member extends in a cross direction intersecting the main scanning direction and moves in the main scanning direction along the guide rail. The cleaning member is held by the holding member and cleans a light emitting surface of the light transmitting member by means of movement of the holding member in the main scanning direction.

6 Claims, 7 Drawing Sheets

OPTICAL SCANNING DEVICE HAVING CLEANING UNIT AND IMAGE FORMING APPARATUS HAVING THE SAME

INCORPORATION BY REFERENCE

This application is based upon and claims the benefit of priority from the corresponding Japanese Patent Application No. 2019-196607 filed on Oct. 29, 2019, the entire contents of which are incorporated herein by reference.

BACKGROUND

The present disclosure relates to an optical scanning device and an image forming apparatus including the optical scanning device.

An electrophotographic image forming apparatus such as a copying machine or a printer is provided with an optical scanning device as an exposure section. The exposure section exposes the surface of a photosensitive drum as an image carrier while scanning the surface with a light beam such as a laser beam to form an electrostatic latent image on the surface of the photosensitive drum. The optical scanning device includes a light source that emits a light beam, an optical system that scans the surface of the photosensitive drum with the light beam, and a housing that contains the light source and the optical system. In order to prevent toner, dust, and the like from entering the housing, a light transmitting member made of glass or the like is provided on a light emission window of the housing. The light transmitting member is elongated in the main scanning direction.

Toner, dust, and the like scattered around the optical scanning device may adhere to the surface of the light transmitting member. In that case, the light beam is prevented from traveling, and an appropriate electrostatic latent image may not be formed on the surface of the photosensitive drum. A known optical scanning device includes a cleaning member for cleaning off toner, dust, and the like adhering to the surface of the light transmitting member.

A typical optical scanning device includes a housing having a light emission port extending in a predetermined direction (main scanning direction), a transparent cover closing the light emission port, a screw shaft extending in the predetermined direction along the transparent cover, a holding member that reciprocates along the screw shaft, and a cleaning member for cleaning the transparent cover held by the holding member. When the holding member reciprocates along the screw shaft, the cleaning member moves in the predetermined direction to clean the surface of the transparent cover.

SUMMARY

An optical scanning device according to the present disclosure includes a light transmitting member, a guide rail, a holding member, and a cleaning member. The light transmitting member extends in a main scanning direction and transmits a light beam. The guide rail extends in the main scanning direction and is arranged parallel to the light transmitting member. The holding member extends in a cross direction intersecting the main scanning direction and moves in the main scanning direction along the guide rail. The cleaning member is held by the holding member and cleans a light emitting surface of the light transmitting member by means of movement of the holding member in the main scanning direction. The holding member includes a guiding section, a slit, and a protrusion. The guiding section is disposed at a position, where the holding member intersects the guide rail. The slit is provided in the guiding section, extends in the main scanning direction with a predetermined spacing in the cross direction, and allows the guide rail to be inserted into the slit. The protrusion is provided on an inner surface of the slit, faces the guide rail in the cross direction and protrudes toward the guide rail. The protrusion is arranged on both sides in the cross direction of the guide rail and is one or more in number for each side. The protrusion on one side in the cross direction and the protrusion on another side in the cross direction are disposed at positions shifted from each other in the main scanning direction.

DETAILED DESCRIPTION

Hereinafter, an embodiment of the present disclosure will be described with reference to the drawings. The present disclosure is not limited to the following contents.

Figure 1:
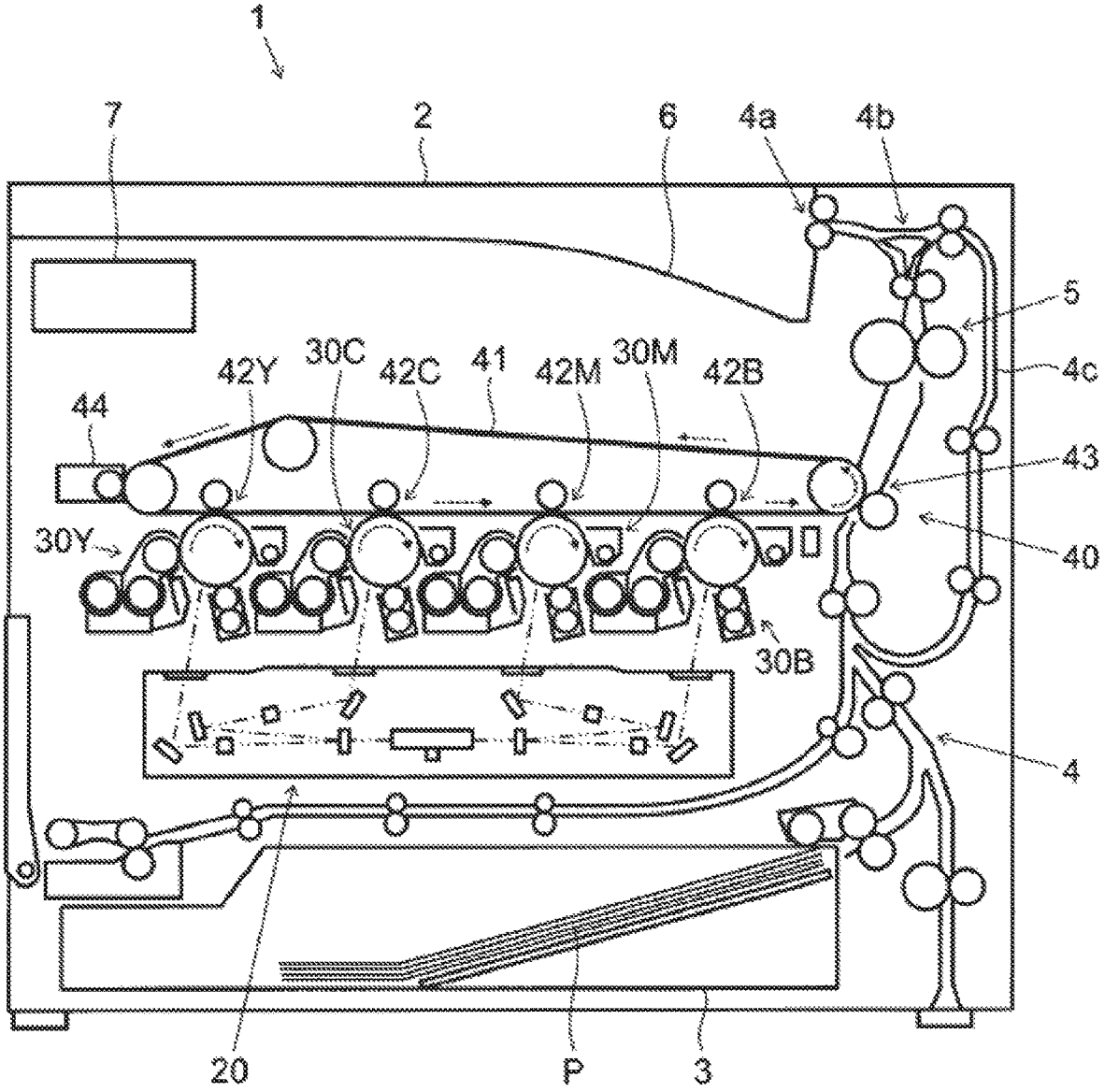
FIG. 1 is a schematic vertical cross-sectional front view illustrating a configuration of an image forming apparatus according to an embodiment of the present disclosure.

FIG. 1 is a schematic cross-sectional view illustrating the configuration of an image forming apparatus 1 according to an embodiment. An example of the image forming apparatus 1 of the present embodiment is a tandem-type color printer that transfers a toner image onto a sheet P using an intermediate transfer belt 41. The image forming apparatus 1 may be a so-called multifunction peripheral having a print making (printing) function, a scanning (image reading) function, a facsimile transmitting function, and the like.

As shown in FIG. 1, the image forming apparatus 1 includes, in a main body 2 thereof, a sheet feeding part 3, a sheet conveying part 4, an optical scanning device 20, image forming units 30, a transferring part 40, a fixing part 5, a sheet discharging part 6, and a controller 7.

The sheet feeding part 3 accommodates a plurality of sheets P, and separates and feeds the sheets P one by one at the time of printing. The sheet conveying part 4 conveys the sheet P fed from the sheet feeding part 3 to a secondary transfer unit 43 and the fixing part 5, and then discharges the sheet P after fixing to the sheet discharging part 6 through a sheet discharge port 4*a*. In a case where double-sided printing is performed, the sheet conveying part 4 distributes the sheet P after the fixing on the first surface to a reverse conveyance section 4*c* by a branch 4*b*, and conveys the sheet P again to the secondary transfer unit 43 and the fixing part 5. The optical scanning device 20 irradiates the image forming units 30 with a light beam of laser light controlled based on image data.

The image forming units 30 include an image forming unit 30Y for yellow, an image forming unit 30C for cyan, an image forming unit 30M for magenta, and an image forming unit 30B for black. The four image forming units 30 have the same basic configuration. Consequently in the following description, the identification symbols "Y", "C", "M", and "B" representing the respective colors may be omitted unless specific definition is required.

The image forming units 30 each include a photosensitive drum 31 (see FIG. 2) that is an image carrier rotatably supported in a predetermined direction (clockwise in FIG. 1). In addition, the image forming units 30 each include a charging section, a developing section, and a drum cleaning section (not shown in FIG. 2) around the photosensitive drum 31 along the rotation direction of the photosensitive drum 31. A primary transfer unit 42 is disposed between the developing section and the drum cleaning section.

The charging section charges the surface of the photosensitive drum to a predetermined potential by, for example, a charging roller. Then, an electrostatic latent image of the original image is formed on the surface of the photosensitive drum by the laser beam emitted from the optical scanning device 20. The developing section supplies toner to the electrostatic latent image to develop the electrostatic latent image, thereby forming a toner image. The four image forming units 30 form toner images of different colors.

The transferring part 40 includes the intermediate transfer belt 41, primary transfer units 42Y, 42C, 42M, and 42B, the secondary transfer unit 43, and a belt cleaning unit 44. The intermediate transfer belt 41 is an intermediate transfer body rotatably supported in a predetermined direction (counterclockwise in FIG. 1), on which toner images formed by the four image forming units 30, respectively, are primarily transferred in a sequentially superimposed manner. The four image forming units 30 are arranged on a so-called tandem system, where the image forming units 30 are aligned from the upstream toward the downstream in the rotation direction of the intermediate transfer belt 41.

The primary transfer units 42Y, 42C, 42M, and 42B are disposed above the image forming units 30Y, 30C, 30M, and 30B of the respective colors. The secondary transfer unit 43 is disposed upstream from the fixing part 5 in the sheet conveyance direction in the sheet conveying part 4 and downstream from the image forming units 30Y, 30C, 30M, and 30B of the respective colors in the rotation direction of the intermediate transfer belt 41 in the transferring part 40. The belt cleaning unit 44 is disposed upstream from the image forming units 30Y, 30C, 30M, and 30B of the respective colors in the rotation direction of the intermediate transfer belt 41.

The toner images are primarily transferred onto the intermediate transfer belt 41 in the primary transfer units 42Y, 42C, 42M, and 42B of the respective colors. As the intermediate transfer belt 41 rotates, the toner images of the respective image forming units 30 are successively transferred to the intermediate transfer belt 41 in a superimposed manner at a predetermined timing, whereby a color toner image, in which toner images of four colors, yellow, cyan, magenta, and black, are superimposed, is formed on the surface of the intermediate transfer belt 41. The drum cleaning section cleans the surface of the photosensitive drum 31 by removing toner and the like remaining on the surface after the primary transfer.

The color toner image on the surface of the intermediate transfer belt 41 is transferred onto the sheet P, which is synchronously fed by the sheet conveying part 4, in a secondary transfer nip section formed in the secondary transfer unit 43. The belt cleaning unit 44 removes toner and the like remaining on the surface of the intermediate transfer belt 41 after the second transfer to clean the surface.

The fixing part 5 fixes the toner image to the sheet P by heating and pressing the sheet P, to which the toner image has been transferred.

The controller 7 includes a central processing unit (CPU), an image processing unit, a storage unit, and other electronic circuits and electronic components (not shown). The CPU controls the operation of each component provided in the image forming apparatus 1 based on a control program and data stored in the storage unit to perform processing related to the functions of the image forming apparatus 1. Each of the sheet feeding part 3, the sheet conveying part 4, the optical scanning device 20, the image forming units 30, the transferring part 40, and the fixing part 5 individually receives a command from the controller 7 and performs printing on the sheet P in conjunction with each other. The storage unit includes a combination of a nonvolatile storage device, such as a program read only memory (ROM) and a data ROM, and a volatile storage device, such as a random access memory (RAM), both not shown.

Figure 2:
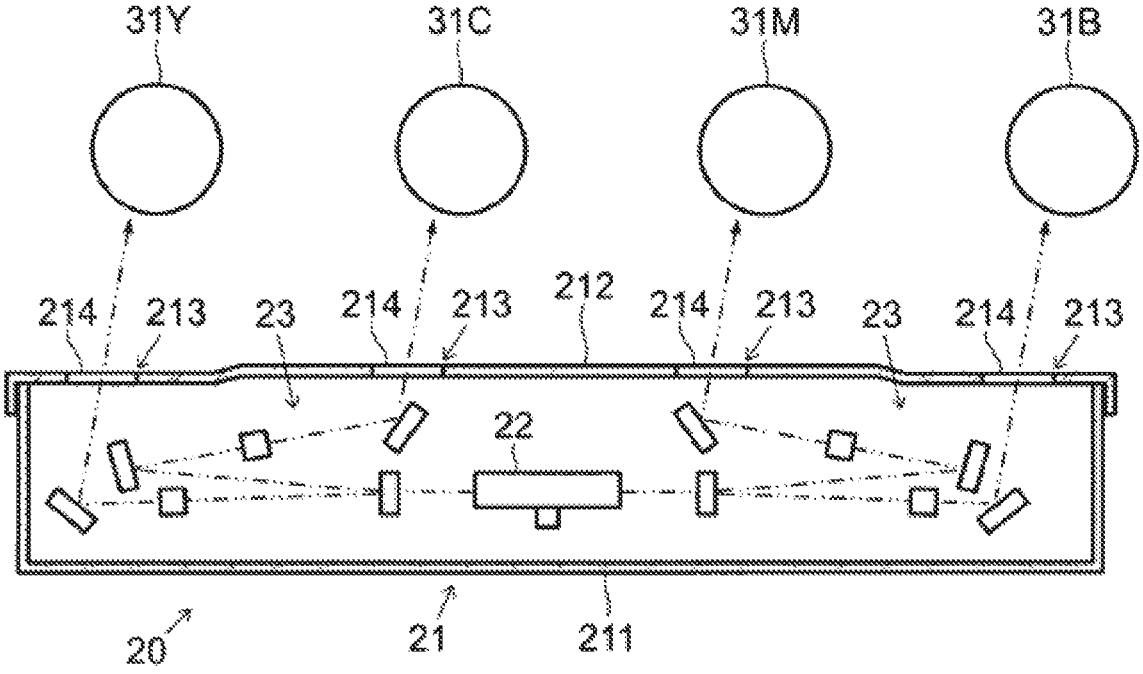
FIG. 2 is a schematic vertical cross-sectional front view illustrating a configuration of an optical scanning device of the image forming apparatus according to the embodiment of the present disclosure.
Figure 3:
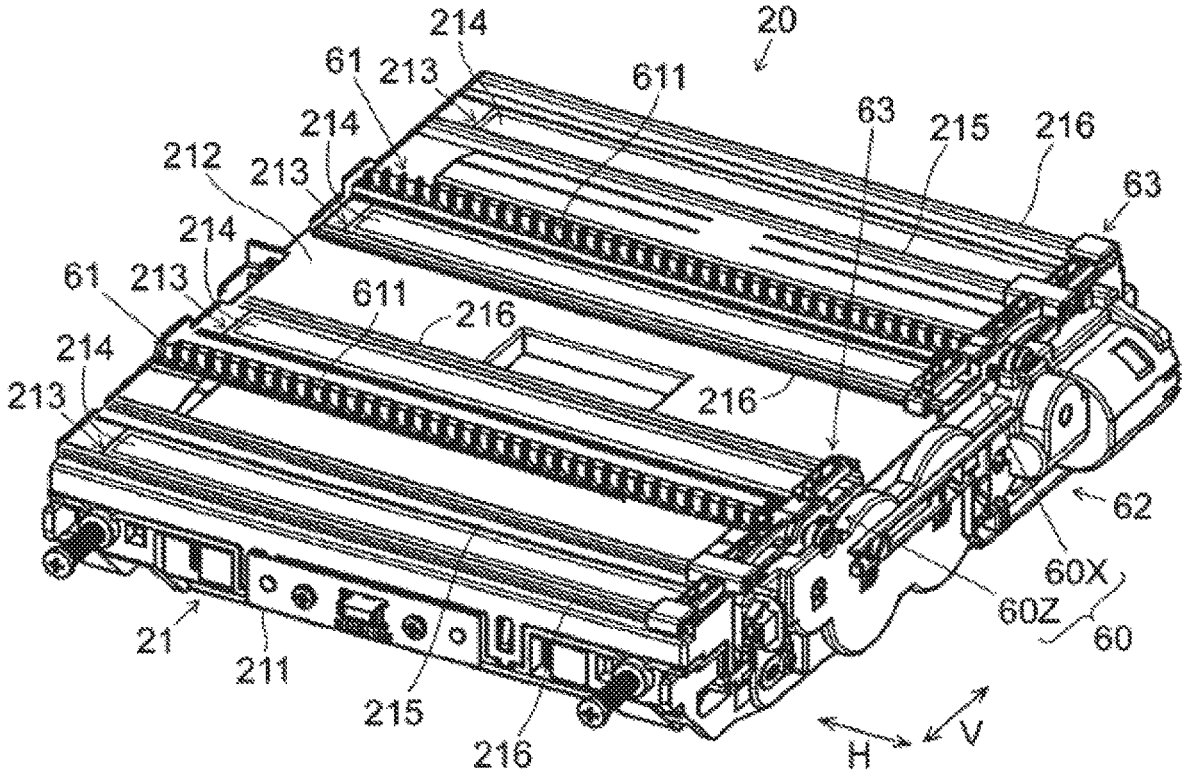
FIG. 3 is a perspective view illustrating an external appearance of the optical scanning device of the image forming apparatus according to the embodiment of the present disclosure.
Figure 4:
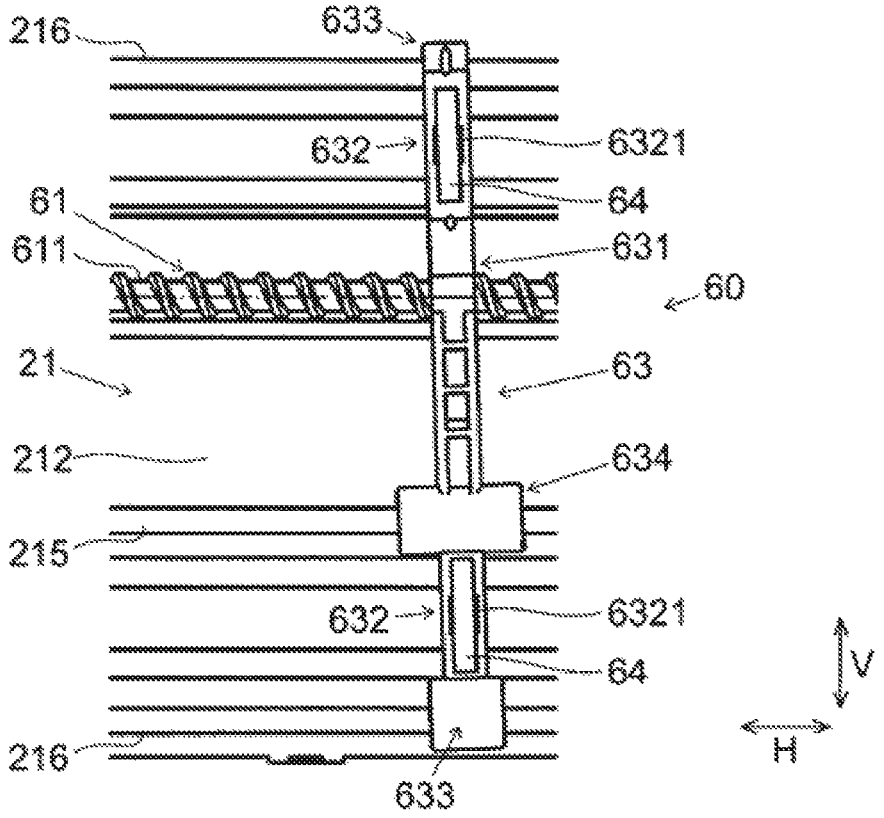
FIG. 4 is a partial plan view of the optical scanning device of the image forming apparatus according to the embodiment of the present disclosure.

Next, the configuration of the optical scanning device 20 will be described with reference to FIGS. 2, 3, and 4 in addition to FIG. 1. FIG. 2 is a schematic vertical cross-sectional front view showing the configuration of the optical scanning device 20 of the image forming apparatus 1. FIG. 3 is a perspective view illustrating an external appearance of the optical scanning device 20 of the image forming apparatus 1. FIG. 4 is a partial plan view of the optical scanning device 20 of the image forming apparatus 1.

As shown in FIG. 1, the optical scanning device 20 is disposed below the four image forming units 30. The optical scanning device 20 is a laser scanning unit designed to mount on the image forming apparatus 1 of a tandem type, which includes four photosensitive drums 31Y, 31C, 31M, and 31B illustrated in FIG. 2 that correspond to four colors, yellow, cyan, magenta, and black, respectively.

As shown in FIGS. 2 and 3, the optical scanning device 20 includes a housing 21, a polygon mirror 22, and an optical system 23.

The housing 21 includes a housing main body 211 and a housing lid 212. The housing main body 211 is formed in a bottomed box shape having an opening on the top side. The housing lid 212 has a substantially flat plate shape that closes the top side opening of the housing main body 211. The housing 21 contains the polygon mirror 22 and the optical system 23.

Further, a light source (not shown) is disposed inside the housing 21. Four independent light sources corresponding to the four colors are provided and arranged in the vicinity of the polygon mirror 22. The light sources are each constituted of, for example, a laser diode so specified as to emit a light beam of laser light in a visible region.

The polygon mirror 22 is disposed inside the housing 21. The polygon mirror 22 is formed in a regular-polygonal shape in a plan view, and a plurality of reflection surfaces for reflecting the light beam are provided on the periphery of the polygon mirror 22. The polygon mirror 22 is rotated about a vertical axis by a motor (not shown). The light beams of laser light emitted from the four light sources are incident on the reflection surfaces around the polygon mirror 22 in a state of being each shifted by a small angle in the vertical direction (sub-scanning direction). The polygon mirror 22 reflects the light beams with the reflection surfaces while rotating, and guides the light beams to the optical system 23 while deflecting the light beams in the main scanning direction.

The optical system 23 is disposed in a region inside the housing 21 where the light beams reflected by the polygon mirror 22 are going to travel. The optical system 23 includes, for example, an fθ lens and a reflection mirror. The fθ lens deflects the light beams corresponding to the respective colors as reflected by the polygon mirror 22 at a constant speed in the main scanning direction. The reflection mirror reflects a light beam in a predetermined direction, and causes the light beam to reach the surface of the photosensitive drum 31, which is the surface to be scanned, to form an image.

The housing lid 212 includes a window 213 and a light transmitting member 214. A light beam emitted from one of the light sources passes through the window 213 when the light beam travels toward the surface to be scanned of the photosensitive drum 31. The light transmitting member 214 covers the window 213 and transmits the light beam. The window 213 and the light transmitting member 214 are each four in number correspondingly to the light beams of the four colors. The four windows 213 and the four light transmitting members 214 are arranged side by side along the rotation direction of the intermediate transfer belt 41, similarly to the four photosensitive drums 31, namely, the photosensitive drums 31Y, 31C, 31M, and 31B. The four windows 213 and the four light transmitting members 214 each have a rectangular shape in a plan view that extends in the main scanning direction. The light transmitting members 214 are made of, for example, dust-proof glass, and close the windows 213 so that dust such as scattered toner may not enter the housing 21 through the windows 213.

As shown in FIG. 3, a cleaning unit 60 is provided outside the housing 21. The cleaning unit 60 includes a first cleaning unit 60X and a second cleaning unit 60Z. For the following description, an arrow indicating a direction H as the main scanning direction and an arrow indicating a direction V as the cross direction intersecting the main scanning direction are drawn in FIG. 3 and succeeding figures.

The first cleaning unit 60X cleans light emitting surfaces of two light transmitting members 214 transmitting, for example, a yellow light beam and a cyan light beam, respectively. The second cleaning unit 60Z cleans light emitting surfaces of two light transmitting members 214 transmitting, for example, a magenta light beam and a black light beam, respectively. The first cleaning unit 60X and the second cleaning unit 60Z have the same basic configuration and are hereinafter also referred to collectively as "the cleaning unit 60".

As illustrated in FIGS. 3 and 4, the cleaning unit 60 includes a screw shaft 61, a drive section 62, a holding member 63, and a cleaning member 64.

The screw shaft 61 is disposed between the two light transmitting members 214. The screw shaft 61 extends in the main scanning direction H and is, accordingly, parallel to the light transmitting members 214. The screw shaft 61 is rotatably supported at both ends in the axial direction by side walls of the housing 21. One end in the axial direction of the screw shaft 61 is connected to the drive section 62.

The drive section 62 is provided on a side wall of the housing 21 on one end side in the main scanning direction H. The drive section 62 includes a driving motor and a group of driving gears (not shown). The drive section 62 is connected to one end in the axial direction of the screw shaft 61. The drive section 62 rotates the screw shaft 61 about the axis by the driving force of the driving motor.

The drive section 62 as provided is one in number and is shared between the first cleaning unit 60X and the second cleaning unit 60Z. When the drive section 62 operates, the screw shafts 61 of the first cleaning unit 60X and the second cleaning unit 60Z are simultaneously rotated in the same direction.

The holding member 63 is formed in a bar shape extending in the cross direction V intersecting the main scanning direction. The holding member 63 is attached to the screw shaft 61. The holding member 63 moves in the main scanning direction H with the rotation of the screw shaft 61.

The housing lid 212 includes a guide rail 215. The guide rail 215 extends in the main scanning direction H and is disposed parallel to the light transmitting members 214. The guide rail 215 protrudes upward from the upper surface of the housing lid 212. The holding member 63 is in contact with the guide rail 215 and is guided by the guide rail 215 when moving. Accordingly, the holding member 63 moves in the main scanning direction H along the guide rail 215.

The cleaning member 64 is held by the holding member 63. Specifically, two cleaning members 64 are held by one holding member 63. The cleaning member 64 protrudes below the holding member 63. The cleaning member 64 cleans the light emitting surfaces of the light transmitting members 214 by the movement of the holding member 63 in the main scanning direction H.

Figure 5:
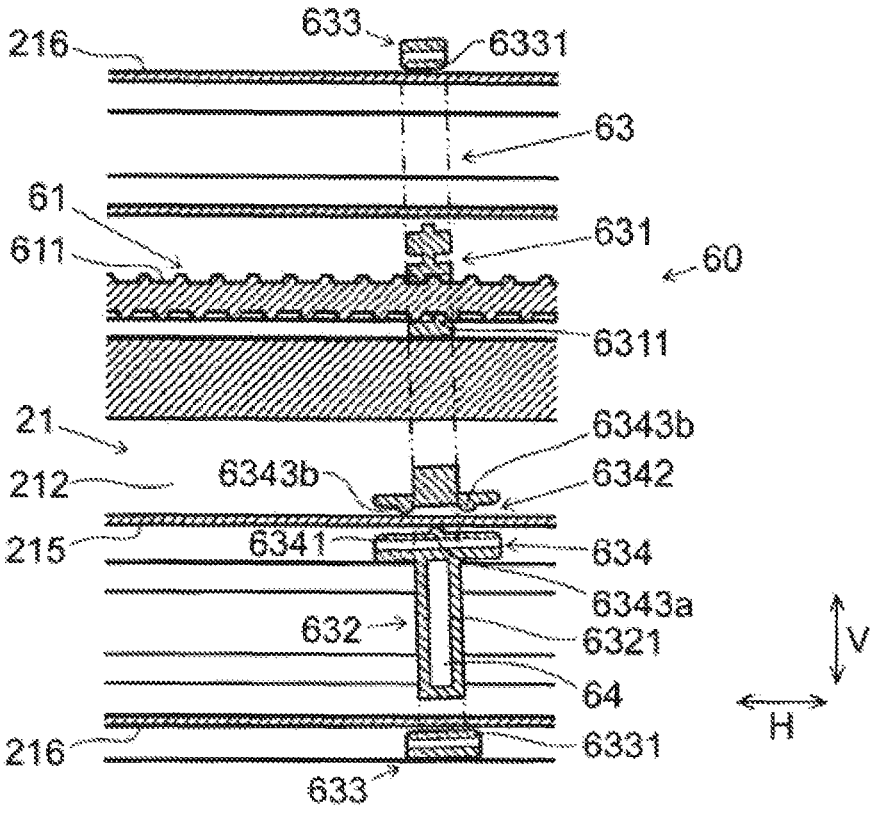
FIG. 5 is a partial horizontal cross-sectional plan view of the optical scanning device of the image forming apparatus according to the embodiment of the present disclosure.
Figure 6:
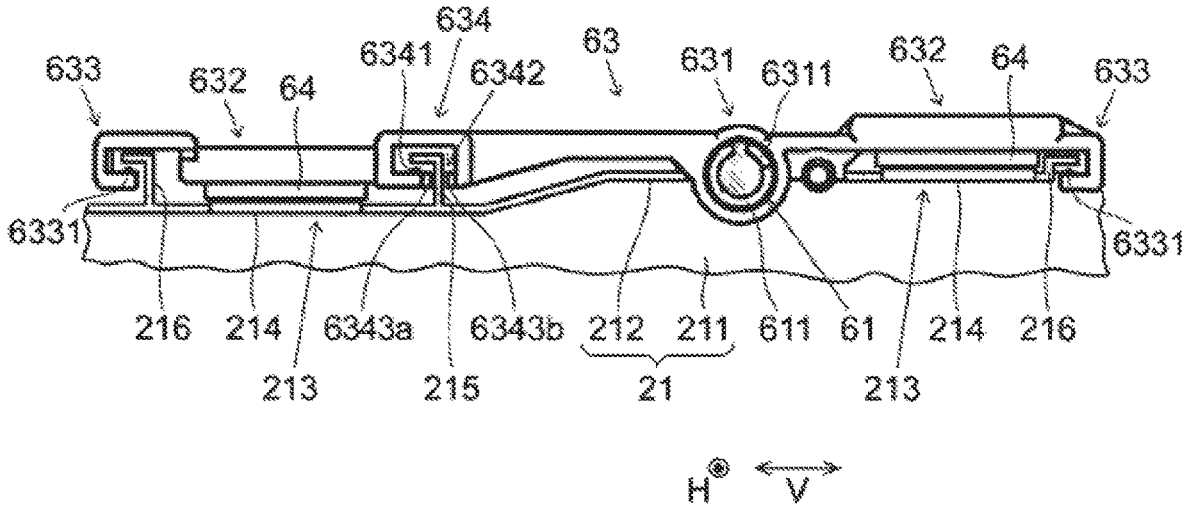
FIG. 6 is a side view of a holding member of the optical scanning device of the image forming apparatus according to the embodiment of the present disclosure.
Figure 7:
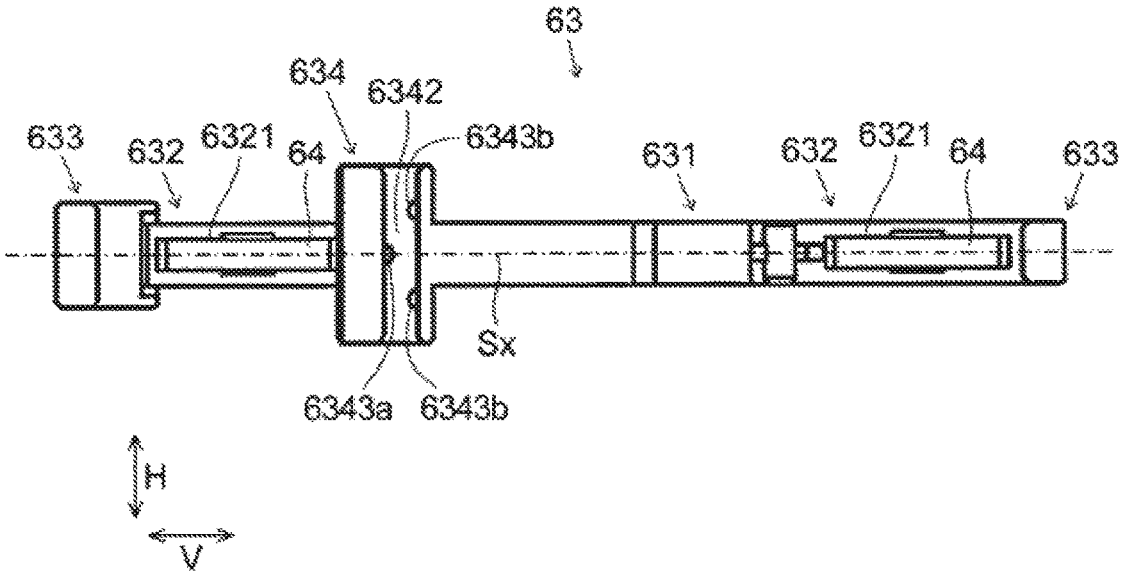
FIG. 7 is a bottom view of the holding member of the optical scanning device of the image forming apparatus according to the embodiment of the present disclosure.
Figure 8:
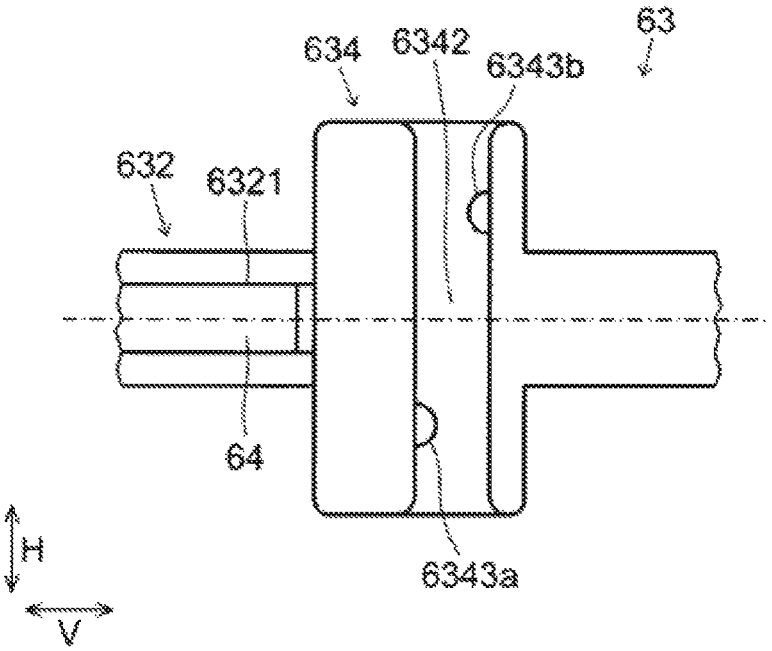
FIG. 8 is a partial bottom view of a holding member of an optical scanning device of an image forming apparatus according to a first modification of the embodiment of the present disclosure.
Figure 9:
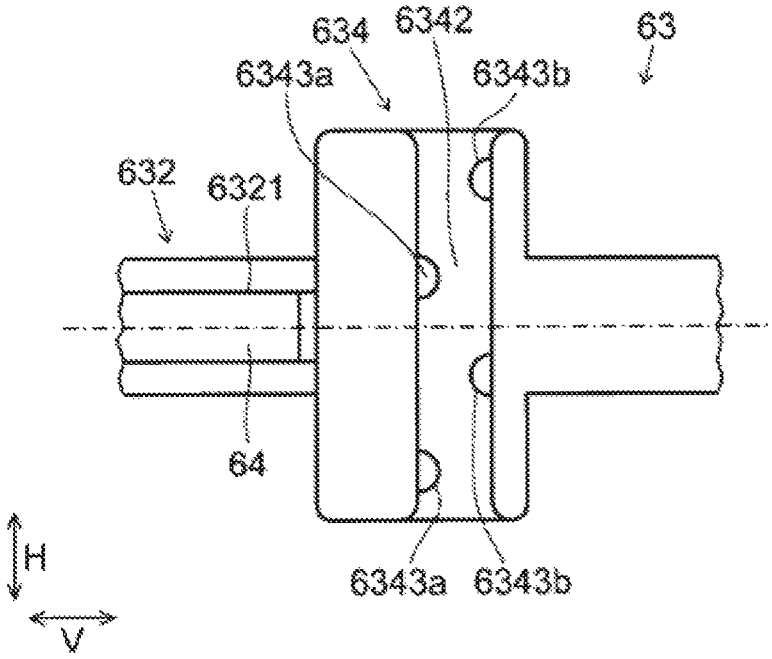
FIG. 9 is a partial bottom view of a holding member of an optical scanning device of an image forming apparatus according to a second modification of the embodiment of the present disclosure.

Next, a detailed configuration of the cleaning unit 60 will be described with reference to FIGS. 5, 6, 7, 8, and 9 in addition to FIGS. 3 and 4. FIG. 5 is a partial horizontal cross-sectional plan view of the optical scanning device 20 of the image forming apparatus 1. FIG. 6 is a side view of the holding member 63 of the optical scanning device 20 of the image forming apparatus 1. FIG. 7 is a bottom view of the holding member 63 of the optical scanning device 20 of the image forming apparatus 1. FIG. 8 is a partial bottom view of the holding member 63 of the optical scanning device 20 of the image forming apparatus 1 according to a first modification of the embodiment. FIG. 9 is a partial bottom view of the holding member 63 of the optical scanning device 20 of the image forming apparatus 1 according to a second modification of the embodiment.

As shown in FIGS. 3, 4, and 5, a spiral concave portion 611 is provided in the outer peripheral surface of the screw shaft 61. The spiral concave portion 611 is recessed radially inward from the outer peripheral surface of the screw shaft 61. The spiral concave portion 611 is provided over the entire region in the axial direction of the outer peripheral surface of the screw shaft 61.

As shown in FIGS. 4, 5, 6, and 7, the holding member 63 includes a tubular portion 631, a holding section 632, a regulating section 633, and a guiding section 634.

The tubular portion 631 is disposed at a position, where the holding member 63 intersects the screw shaft 61. The axis of the tubular portion 631 is parallel to the axis of the screw shaft 61, and the screw shaft 61 is inserted into the tubular portion 631. A spiral convex portion 6311 is provided on the inner peripheral surface of the tubular portion 631. The spiral convex portion 6311 protrudes radially inward from the inner peripheral surface of the tubular portion 631. The spiral convex portion 6311 is provided on the inner peripheral surface of the tubular portion 631 along the axial direction. The spiral convex portion 6311 is inserted into the spiral concave portion 611 of the screw shaft 61.

The holding section 632 is disposed at a position, where the holding member 63 intersects the light transmitting member 214. That is, the holding member 63 includes two holding sections 632 corresponding to the two light transmitting members 214. The holding section 632 extends in the cross direction V intersecting the main scanning direction and includes a receiver 6321 provided with a vertical through hole. In the cross direction V intersecting the main scanning direction, the length of the receiver 6321 is longer than the length of the light transmitting member 214. The receiver 6321 receives the cleaning member 64. Each of the two holding sections 632 accommodates and holds a separate cleaning member 64 in the receiver 6321.

The cleaning member 64 protrudes downward from the holding member 63 and is, at the lower end, in contact with the light emitting surface of the light transmitting member 214. The cleaning member 64 is made of, for example, silicone rubber and has a portion in contact with the light transmitting member 214 that is formed in a blade shape. In the cross direction V intersecting the main scanning direction, the length of the cleaning member 64 is longer than the length of the light transmitting member 214. The cleaning member 64 may be made of another material such as nonwoven fabric or felt.

The regulating section 633 is disposed at both ends of the holding member 63 in the cross direction V intersecting the main scanning direction. The regulating section 633 extends downward and is bent in a direction toward the tubular portion 631, so that the regulating section 633 is formed in a U shape when viewed in the main scanning direction H. In a bent edge portion of the regulating section 633, a convex portion 6331 protruding upward and extending in the main scanning direction H is provided.

The housing lid 212 includes a regulation rail 216. Specifically, two regulation rails 216 corresponding to two regulating sections 633 are separately provided at two places intersecting the two regulating sections 633, respectively. The regulation rail 216 extends in the main scanning direction H and is disposed parallel to the light transmitting members 214. The regulation rail 216 protrudes upward from the upper surface of the housing lid 212 and is bent in a direction away from the tubular portion 631, so that the regulation rail 216 is formed in an L shape when viewed in the main scanning direction H.

An edge portion of the regulation rail 216 is inserted inside a U-shaped portion of the regulating section 633. The edge portion of the regulation rail 216 extends in the cross direction V intersecting the main scanning direction to a position, where the edge portion overlaps the convex portion 6331 of the regulating section 633 in the vertical direction. Accordingly, when an end in the cross direction V intersecting the main scanning direction of the holding member 63 is displaced upward, the convex portion 6331 of the regulating section 633 comes into contact with the lower surface of the edge portion of the regulation rail 216. Therefore, it is possible to suppress upward displacement of the end in the cross direction V intersecting the main scanning direction of the holding member 63. That is, it is possible to maintain the contact state of the cleaning member 64 with the light emitting surface of the light transmitting member 214.

The guiding section 634 is disposed between the tubular portion 631 and one of the regulating sections 633. The guiding section 634 is disposed at a position, where the holding member 63 intersects the guide rail 215. A portion of the guiding section 634 that is farther from the tubular portion 631 than the guide rail 215 extends downward and is bent in a direction toward the tubular portion 631, so that the guiding section 634 is formed in a U shape when viewed in the main scanning direction H. In a bent edge portion of the guiding section 634, a convex portion 6341 protruding upward and extending in the main scanning direction H is provided.

The guide rail 215 protrudes upward from the upper surface of the housing lid 212 and is bent in a direction away from the tubular portion 631, so that the guide rail 215 is formed in an L shape when viewed in the main scanning direction H. An edge portion of the guide rail 215 is inserted inside a U-shaped portion of the guiding section 634. The edge portion of the guide rail 215 extends in the cross direction V intersecting the main scanning direction to a position, where the edge portion overlaps the convex portion 6341 of the guiding section 634 in the vertical direction. Accordingly, when a portion of the holding member 63, where the guiding section 634 is located, is displaced upward, the convex portion 6341 of the guiding section 634 comes into contact with the lower surface of the edge portion of the guide rail 215. Therefore, it is possible to suppress upward displacement of an end in the cross direction V intersecting the main scanning direction of the holding member 63. That is, it is possible to maintain the contact state of the cleaning member 64 with the light transmitting member 214.

As shown in FIGS. 5, 6, and 7, the guiding section 634 further includes a slit 6342 and a protrusion 6343.

The slit 6342 is provided in a lower portion of the guiding section 634 with a predetermined spacing in the cross direction V intersecting the main scanning direction, and extends in the main scanning direction H. The guide rail 215 is inserted into the slit 6342. Specifically, a portion of the guide rail 215 that extends upward from the upper surface of the housing lid 212 is inserted into the slit 6342 along the main scanning direction H.

The protrusion 6343 is provided in the slit 6342. Specifically, the protrusion 6343 is provided on an inner surface of the slit 6342 that faces the guide rail 215 in the cross direction V intersecting the main scanning direction. The protrusion 6343 protrudes toward the guide rail 215 inserted into the slit 6342.

The protrusion 6343 is provided on both sides in the cross direction V intersecting the main scanning direction of the guide rail 215. More specifically, in the present embodiment, one protrusion 6343*a* is provided on one side in the cross direction V intersecting the main scanning direction of the guide rail 215 (a side of the guide rail 215 that is farther from the tubular portion 631), and two protrusions 6343*b* are provided on the other side (a side of the guide rail 215 that is closer to the tubular portion 631), for instance. The protrusion 6343*a* and the protrusions 6343*b* have the same basic configuration and are hereinafter also referred to collectively as "the protrusion 6343".

As shown in FIG. 7, the number of the protrusions 6343*a* and 6343*b* as provided can be two or more on at least one side in the cross direction V intersecting the main scanning direction. In addition, one protrusion 6343*a* may be provided on one side in the cross direction V intersecting the main scanning direction of the guide rail 215 and one protrusion 6343*b* on the other side, as in a first modification illustrated in FIG. 8. It is also possible to provide two or more (two, for instance) protrusions 6343*a* on one side in the cross direction V intersecting the main scanning direction of the guide rail 215 and two or more (two, for instance) protrusions 6343*b* on the other side, as in a second modification illustrated in FIG. 9.

Further, the protrusion 6343*a* on one side and the protrusion 6343*b* on the other side in the cross direction V intersecting the main scanning direction are arranged at positions shifted from each other in the main scanning direction H. In other words, the protrusion 6343*a* and the protrusion 6343*b* do not face each other in the cross direction V intersecting the main scanning direction.

According to the above-described configuration, since the guide rail 215 is inserted into the slit 6342 of the guiding section 634 of the holding member 63, it is possible to suppress the inclination of the holding member 63 with respect to the main scanning direction H as the direction, in which the light transmitting members 214 extend. Further, since the protrusions 6343*a* and 6343*b* of the holding member 63 face the guide rail 215 in the slit 6342, the contact region between the holding member 63 and the guide rail 215 can be reduced. As a result, it is possible to prevent foreign matter such as toner or dust from being caught in the slit 6342 and appropriately move the holding member 63. Therefore, it is possible to suitably clean the light transmitting member 214 using the cleaning member 64.

In addition, by setting the number of the protrusions 6343*a* and 6343*b* to two or more on at least one side in the cross direction V intersecting the main scanning direction as shown in FIG. 7, it is possible to stabilize the posture of the holding member 63. Accordingly, it is possible to enhance the effect of suppressing the inclination of the holding member 63 with respect to the main scanning direction H as the direction, in which the light transmitting members 214 extend. Therefore, it is possible to more suitably clean the light transmitting member 214 using the cleaning member 64.

The protrusions 6343*a* and 6343*b* shown in FIGS. 7 and 9 are arranged along the main scanning direction H in the order of the protrusion 6343*b*, the protrusion 6343*a*, the protrusion 6343*b*, and the protrusion 6343*a* from the top in the figures. That is, the protrusion or protrusions 6343*a* on one side and the protrusions 6343*b* on the other side in the cross direction V intersecting the main scanning direction are alternately arranged along the main scanning direction H. According to such configuration, foreign matter such as toner and dust can easily pass through the gap between the protrusions 6343*a* and 6343*b* and the guide rail 215. Therefore, it is possible to enhance the effect of preventing foreign matter such as toner and dust from being caught in the slit 6342 and appropriately move the holding member 63.

The protrusions 6343 shown in FIG. 7 are arranged in line symmetry with respect to the axis in the main scanning direction H of the guiding section 634 as a symmetry axis Sx. According to such configuration, the posture of the holding member 63 can be stabilized irrespective of the orientation of the holding member 63 moving in the main scanning direction H. Accordingly, it is possible to enhance the effect of suppressing the inclination of the holding member 63 with respect to the main scanning direction H as the direction, in which the light transmitting members 214 extend. Therefore, it is possible to more suitably clean the light transmitting member 214 using the cleaning member 64.

The protrusion 6343 is convex toward the guide rail 215 and has a curved surface that is curved in the main scanning direction H. For example, the protrusion 6343 has a hemispherical shape. According to such configuration, the contact region between the holding member 63 and the guide rail 215 is almost of point contact. Therefore, it is possible to enhance the effect of preventing foreign matter such as toner and dust from being caught in the slit 6342 and appropriately move the holding member 63.

According to the embodiment and modifications as above, the image forming apparatus 1 includes the optical scanning device 20 having the above-described configuration, so that it is possible to suppress the inclination of the holding member 63 with respect to the main scanning direction H as the direction, in which the light transmitting members 214 extend, in the image forming apparatus 1. Further, the contact region between the holding member 63 and the guide rail 215 can be reduced. As a result, it is possible to prevent foreign matter such as toner or dust from being caught in the slit 6342 and appropriately move the holding member 63. Therefore, in the image forming apparatus 1, it is possible to suitably clean the light transmitting member 214 by using the cleaning member 64.

While an embodiment of the present invention has been described above, the scope of the present invention is not limited to the embodiment. Various modifications can be made without departing from the spirit of the present invention.

For example, in the above-described embodiment, the image forming apparatus 1 is a so-called tandem-type image forming apparatus for color printing that sequentially forms images of a plurality of colors in an superimposed manner. The image forming apparatus 1 is in no way limited to such a model but may be an image forming apparatus for color printing that is not of a tandem type or an image forming apparatus for monochrome printing.

In the above-described exemplary embodiment, the holding member 63 includes two holding sections 632 and holds two cleaning members 64, to which the configuration of the holding member 63 is not limited. The holding member 63 may include one holding section 632 to hold one cleaning member 64 or include three or more holding sections 632 to hold three or more cleaning members 64.

What is claimed is:

1. An optical scanning device comprising:

a light transmitting member that extends in a main scanning direction and transmits a light beam;

a guide rail that extends in the main scanning direction and is arranged parallel to the light transmitting member;

a holding member that extends in a cross direction intersecting the main scanning direction and moves in the main scanning direction along the guide rail; and a cleaning member that is held by the holding member and cleans a light emitting surface of the light transmitting member by means of movement of the holding member in the main scanning direction, wherein the guide rail protrudes upward from an upper surface of a housing in which the light transmitting member is housed and is bent in an L shape when viewed in the main scanning direction, wherein the holding member includes:

a guiding section provided with a U-shaped portion and disposed at a position, where the holding member intersects the guide rail;

a slit provided in the guiding section, the slit extending in the main scanning direction with a predetermined spacing in the cross direction and connecting an inside space of the U-shaped portion to an outside of the guiding section, and the guide rail being inserted into the inside space of the U-shaped portion through the slit; and a protrusion provided on an inner surface of the slit, the protrusion facing the guide rail in the cross direction and protruding toward the guide rail, wherein the protrusion is arranged on both sides in the cross direction of the guide rail and is one or more in number for each side, and wherein the protrusion on one side in the cross direction and the protrusion on another side in the cross direction are disposed at positions shifted from each other in the main scanning direction.

2. The optical scanning device according to claim 1, wherein the protrusion is two or more in number on at least one side in the cross direction.

3. The optical scanning device according to claim 2, wherein two or more protrusions on one side in the cross direction and one or more protrusions on another side in the cross direction are alternately arranged along the main scanning direction.

4. The optical scanning device according to claim 3, wherein the protrusions are arranged in line symmetry with respect to an axis in the main scanning direction of the guiding section as an axis of symmetry.

5. The optical scanning device according to claim 1, wherein the protrusion is convex toward the guide rail and has a curved surface that is curved in the main scanning direction.

6. An image forming apparatus comprising the optical scanning device according to claim 1.

* * * * *